US007497930B2

(12) United States Patent
Barkdoll et al.

(10) Patent No.: US 7,497,930 B2
(45) Date of Patent: Mar. 3, 2009

(54) METHOD AND APPARATUS FOR COMPACTING COAL FOR A COAL COKING PROCESS

(75) Inventors: Michael P. Barkdoll, Knoxville, TN (US); Mark A. Ball, Richlands, VA (US); Daniel Korrect, Knoxville, TN (US); Richard C. Retort, Edinburg, PA (US)

(73) Assignee: SunCoke Energy, Inc., Knoxville, TN (US)

( * ) Notice: Subject to any disclaimer, the term of this patent is extended or adjusted under 35 U.S.C. 154(b) by 291 days.

(21) Appl. No.: 11/424,566

(22) Filed: Jun. 16, 2006

(65) Prior Publication Data

US 2007/0289861 A1 Dec. 20, 2007

(51) Int. Cl.
*C10B 33/00* (2006.01)
*C10B 35/00* (2006.01)
*B27N 3/00* (2006.01)

(52) U.S. Cl. ..... 201/41; 202/227; 202/262; 264/109

(58) Field of Classification Search ..... 202/262, 202/227; 201/41; 414/160; 44/501; 264/109
See application file for complete search history.

(56) References Cited

U.S. PATENT DOCUMENTS 2,424,012 A * 7/1947 Bangham et al. ..... 106/273.1
3,784,034 A * 1/1974 Thompson ..... 414/180
4,067,462 A * 1/1978 Thompson ..... 414/214
4,189,272 A 2/1980 Gregor et al.
4,396,394 A * 8/1983 Li et al. ..... 44/501
4,508,539 A * 4/1985 Nakai ..... 34/398
4,645,513 A * 2/1987 Kubota et al. ..... 44/501
6,059,932 A * 5/2000 Sturgulewski ..... 202/262
6,139,692 A * 10/2000 Tamura et al. ..... 201/41
6,290,494 B1 * 9/2001 Barkdoll ..... 432/121

FOREIGN PATENT DOCUMENTS

CN 2509188 Y 11/2001
CN 2528771 Y 2/2002
CN 1358822 A 7/2002

OTHER PUBLICATIONS 03-197588, Inoqu Keizo et al., Method And Equipment For Boring Degassing Hole In Coal Charge In Coke Oven, Japanese Patent (Abstract Only) Aug. 28, 1991.
04-159392, Inoue Keizo et al., Method And Equipment For Opening Hole For Degassing Of Coal Charge In Coke Oven, Japanese Patent (Abstract Only) Jun. 2, 1992.

* cited by examiner

*Primary Examiner*—N. Bhat
(74) *Attorney, Agent, or Firm*—Luedeka, Neely & Graham, PC

(57) ABSTRACT

Relatively high speed methods for increasing the bulk density of coal particles, apparatus for increasing the bulk density of coal particles and methods for making metallurgical coke. Once such method includes depositing coal particles onto a charging plate external to a coking oven to provide an elongate bed of dry, uncompacted coal having an upper surface of the charging plate. The charging plate has side walls, and at least one movable end wall An impact pressure is applied to the upper surface of the bed of dry, uncompacted coal while degassing the coal to provide a dry, compacted coal bed having a bulk density ranging from about 960 to about 1200 kilograms per cubic meter.

24 Claims, 16 Drawing Sheets

METHOD AND APPARATUS FOR COMPACTING COAL FOR A COAL COKING PROCESS

TECHNICAL FIELD

The disclosure relates to a method and apparatus for making coke from coal and in particular to an improved method and apparatus for compacting coal for feed to a non-recovery coking oven.

BACKGROUND AND SUMMARY

Coke is a solid carbon fuel and carbon source used to melt and reduce iron ore in the production of steel. During an iron-making process, iron ore, coke, heated air and limestone or other fluxes are fed into a blast furnace. The heated air causes combustion of the coke that provides heat and a source of carbon for reducing iron oxides to iron. Limestone or other fluxes may be added to react with and remove the acidic impurities, called slag, from the molten iron. The limestone-impurities float to the top of the molten iron and are skimmed off.

In one process, known as the "Thompson Coking Process," coke used for refining metal ores, as described above, is produced by batch feeding pulverized coal to an oven that is sealed and heated to very high temperatures for 24 to 48 hours under closely controlled atmospheric conditions. Coking ovens have been used for many years to covert coal into metallurgical coke. During the coking process, finely crushed coal is heated under controlled temperature conditions to devolatilize the coal and form a fused mass having a predetermined porosity and strength. Because the production of coke is a batch process, multiple coke ovens are operated simultaneously, hereinafter referred to as a "coke oven battery".

At the end of the coking cycle, the finished coke is removed from the oven and quenched with water. The cooled coke may be screened and loaded onto rail cars or trucks for shipment or later use or moved directly to an iron melting furnace.

The melting and fusion process undergone by the coal particles during the heating process is the most important part of the coking process. The degree of melting and degree of assimilation of the coal particles into the molten mass determine the characteristics of the coke produced. In order to produce the strongest coke from a particular coal or coal blend, there is an optimum ratio of reactive to inert entities in the coal. The porosity and strength of the coke are important for the ore refining process and are determined by the coal source and/or method of coking.

Coal particles or a blend of coal particles are charged into hot ovens on a predetermined schedule, and the coal is heated for a predetermined period of time in the ovens in order to remove volatiles from the resulting coke. The coking process is highly dependent on the oven design, the type of coal and conversion temperature used. Ovens are adjusted during the coking process so that each charge of coal is coked out in approximately the same amount of time. Once the coal is coked out, the coke is removed from the oven and quenched with water to cool it below its ignition temperature. The quenching operation must also be carefully controlled so that the coke does not absorb too much moisture. Once it is quenched, the coke is screened and loaded into rail cars or trucks for shipment.

Because coal is fed into hot ovens, much of the coal feeding process is automated. In slot-type ovens, the coal is typically charged through slots or openings in the top of the ovens.

Such ovens tend to be tall and narrow. More recently, horizontal non-recovery or heat recovery type coking ovens have been used to produce coke. Horizontal ovens are described for example in U.S. Pat. Nos. 3,784,034 and 4,067,462 to Thompson. In the non-recovery or heat recovery type coking ovens, conveyors are used to convey the coal particles horizontally into the ovens to provide an elongate bed of coal having a height of about 101 centimeters, a length of about 13.7 meters, and a width of about 3.6 meters.

As the source of coal suitable for forming metallurgical coal has decreased, attempts have been made to blend weak or non-coking coals with coking coals to provide a suitable coal charge for the ovens. One attempt is to use compacted coal. The coal may be compacted before or after it is in the oven. While coal conveyors are suitable for charging ovens with particulate coal that is then partially compacted in the oven, such conveyors are generally not suitable for charging ovens with pre-compacted coal. Ideally, the coal should be compacted to greater than 50 pounds per cubic foot in order to enhance the usefulness of lower quality coal. It is well known that as the percentage of lower quality coal in a coal blend is increased, higher levels of coal compaction are required up to about 65 to 70 pounds per cubic foot However, currently available processes are not suitable for providing a compacted coal charge that has a substantially uniform bulk density throughout the entire depth of an elongate coal charge bed. Such processes are also complicated and time consuming. There is a need therefor, for a method and apparatus for compacting coal and charging coking ovens with pre-compacted coal. There is also a need for an apparatus for minimizing the amount of time required to provide a substantially uniform bed of compacted coal for use in making metallurgical coke.

In accordance with the foregoing and other needs, the disclosure provides relatively high speed methods for increasing the bulk density of coal particles, apparatus for increasing the bulk density of coal particles and methods for making metallurgical coke. Once such method includes depositing coal particles onto a charging plate external to a coking oven to provide an elongate bed of dry, uncompacted coal having an upper surface of the charging plate. The charging plate has side walls, and at least one movable end wall. An impact pressure is applied to the upper surface of the bed of dry, uncompacted coal while degassing the coal to provide a dry, compacted coal bed having a bulk density ranging from about 960 to about 1200 kilograms per cubic meter.

In another aspect, an exemplary embodiment of the disclosure provides a coal compacting and coke oven charging apparatus. The apparatus has a coal bed transfer plate having side walls, at least one movable end wall, and a transfer plate translating mechanism for transporting compacted coal into the coke oven. A coal compaction device is provided to compact the coal. The coal compaction device has a pressure plate for applying pressure to an upper surface of a dry, uncompacted bed of coal deposited on the transfer plate. A vacuum source is used for degassing the uncompacted bed of coal during the compaction process to provide a dry, compacted coal bed having a bulk density ranging from about 960 to about 1200 kilograms per cubic meter.

In yet another aspect, an exemplary embodiment of the disclosure provides a method for operating a horizontal non-recovery coke oven using a relatively low quality coal source. The method includes depositing coal particles on a transfer plate device to provide an uncompacted bed of coal. The transfer plate device has a translatable spatula, side walls and at least one movable end wall. A pressure is applied to an upper surface of the uncompacted coal bed while degassing the coal bed to provide a dry, compacted coal bed having a bulk density ranging from about 960 to about 1200 kilograms per cubic meter. The spatula containing compacted coal is translated into the coke oven and is removed from the coke oven while retaining the compacted coal in the coke oven. A coking process is then conducted on the compacted coal in the coke oven.

The method and apparatus described herein provide unique advantages for coking operations including providing coal with a relatively high bulk density in a relatively short period of time. Another advantage of the method and apparatus is that relatively simple mechanical devices may be used to compact the coal and transfer the compacted coal into the coke oven. A further advantage is that the resulting coal bed is substantially compacted throughout its depth to about the same uniform bulk density.

BRIEF DESCRIPTION OF THE DRAWINGS

Further advantages of the disclosed embodiments may be apparent by reference to the detailed description of exemplary embodiments when considered in conjunction with the drawings, which are not to scale, wherein like reference characters designate like or similar elements throughout the several drawings as follows.

DETAILED DESCRIPTION OF THE PRFERRED EMBODIMENTS

Figure 1:
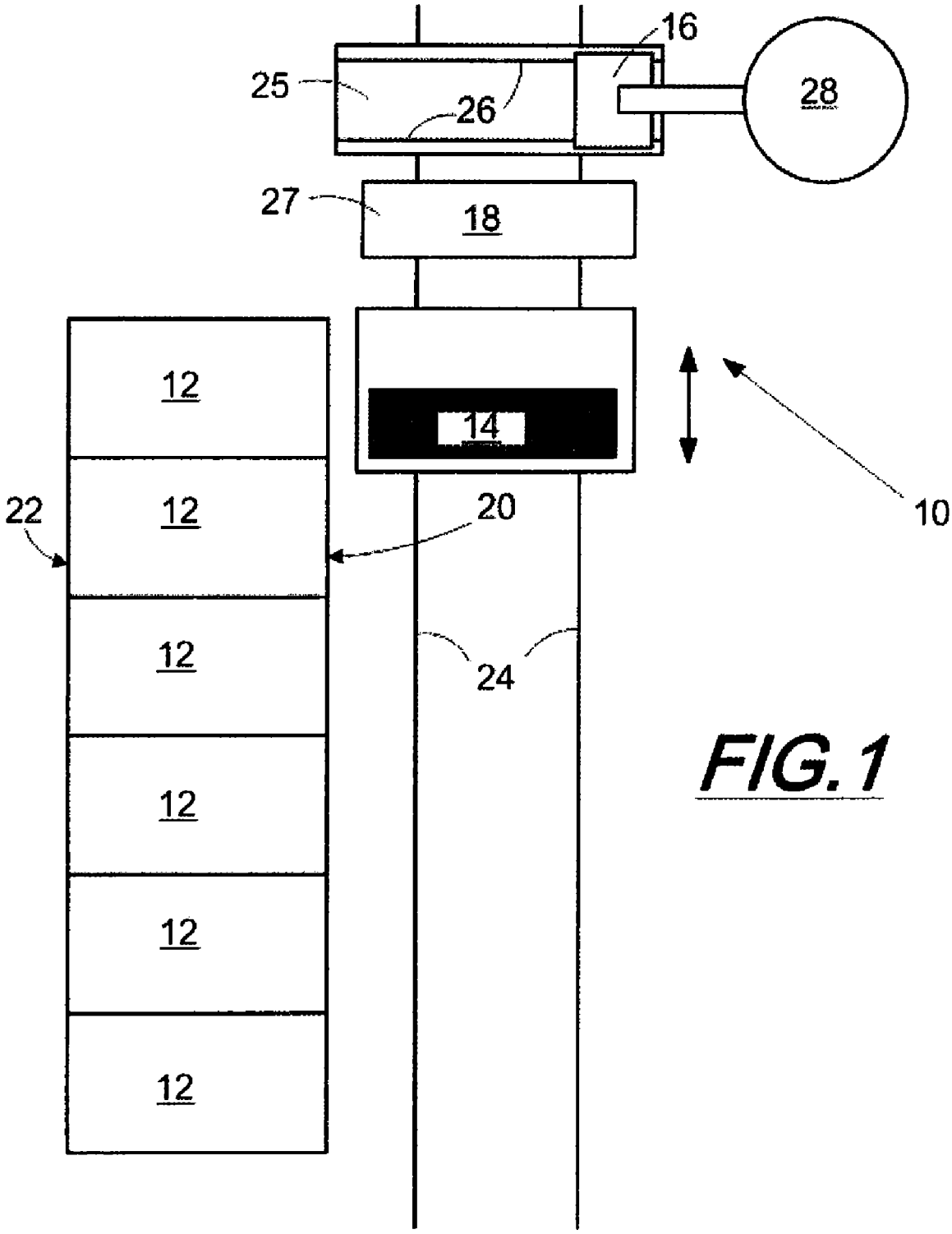
FIG. 1 is a schematic plan view, not to scale, of a charging car, coal filling station, and compaction station for a coke oven battery according an embodiment of the disclosure.

As described in more detail below, a high speed system 10 for compacting and charging coal to coke ovens 12 is illustrated in a schematic plan view in FIG. 1. The system includes a movable coal charge car device 14, a coal filling apparatus 16 for filling the coal charge car, and a stationary coal compaction apparatus 18 for compacting the coal in the coal charge car device 14. The system 10 is particularly suitable for providing a compacted bed of coal having a depth of from about 75 to about 125 centimeters, a length ranging from about 10 to about 15 meters and a width ranging from about 2 to about 5 meters for charging a horizontal non-recovery coking oven 12.

A typical horizontal non-recovery coke oven battery contains a plurality of side by side coke ovens 12. Each of the coke ovens 12 has a coal charge end 20 and a coke outlet end 22 opposite the charge end 20. A coal coking cycle may range from 24 to 48 hours or more depending on the size of the coal charge to the coke oven 12. At the end of the coking cycle, the coke is pushed out of the oven 12 into a hot car on the coke outlet end 22 of the oven using a discharge ram positioned adjacent the charge end 20 of the oven 12. The discharge ram may be included on the charge car device 14 which may also include a device for removing a charge end 20 oven door prior to pushing the coke out of the oven 12.

As shown in FIG. 1, the charge car device 14 is movable on rails 24 adjacent to an oven 12 to be charged, to a filling station 25 for filling the charge car device 14 with a predetermined amount of coal, and to a compaction station 27 containing the compaction apparatus 18. The coal filling apparatus 16 is also separately movable on elevated rails 26 orthogonal to rails 24 for movement along a length of the charge car device 14 and for movement to adjacent a storage bin 28 for filling the coal filling apparatus 16 with a predetermined amount of coal.

Figure 2:
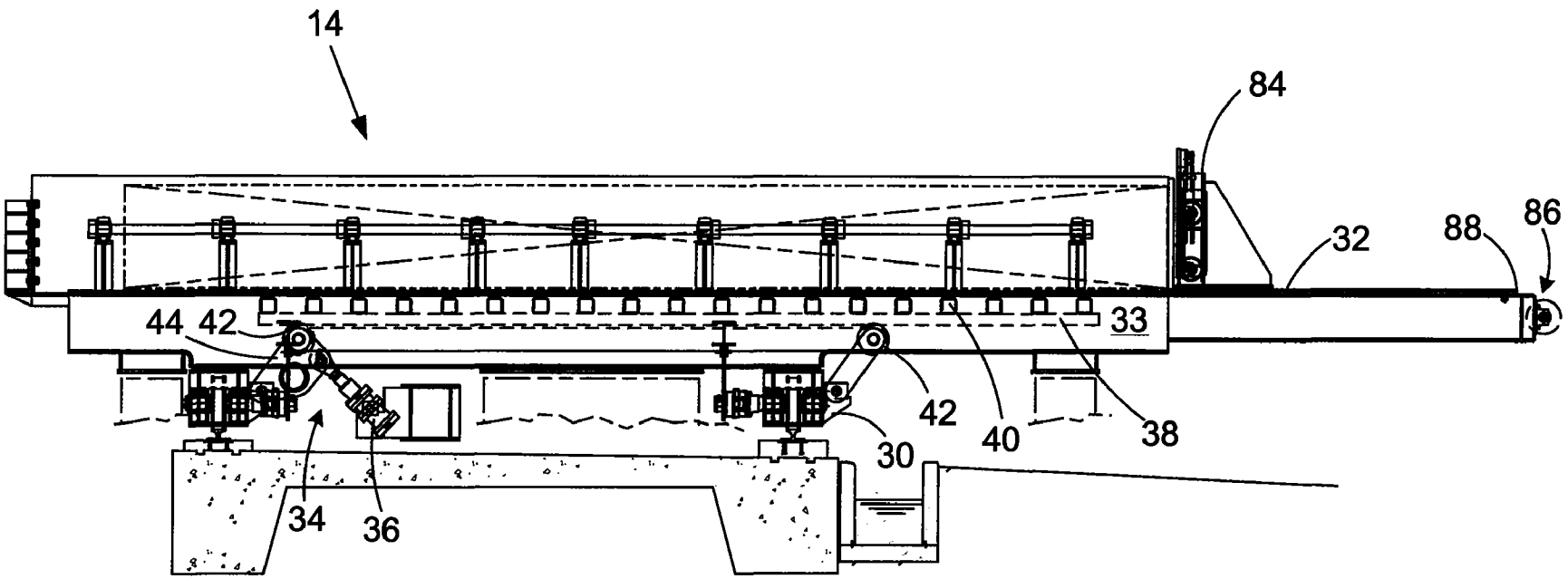
FIG. 2 is an elevational side view, not to scale, of a charge car device according to an embodiment of the disclosure.

With reference now to FIGS. 2-12, various aspects of the components of the system 10 are illustrated and described in more detail. As shown in FIG. 2, the charge car device 14 illustrated includes a main support frame 30, a translatable coal transfer plate or spatula 32, a transfer plate support frame 33, and a height adjustment mechanism 34 attached to the frame 30 for positioning a height of the transfer plate 32 relative to an oven floor for an oven 12 being charged with coal. The height adjustment mechanism 34 may also be used to lower the transfer plate 32 onto stationary piers, described in more detail below, for absorbing impact shock during a coal compaction step.

The height adjustment mechanism 34 includes one or more actuators 36 for raising and lowering bearing rails 38 containing bearing rolls 40 or slide plates for translatable movement of the transfer plate 32. The actuator 36 may be selected from a wide variety of mechanisms such as worm gears, chain drives, hydraulic cylinders, and the like. A hydraulic cylinder actuator 36 is particularly suitable for use in the height adjustment mechanism 34 described herein.

Figure 3:
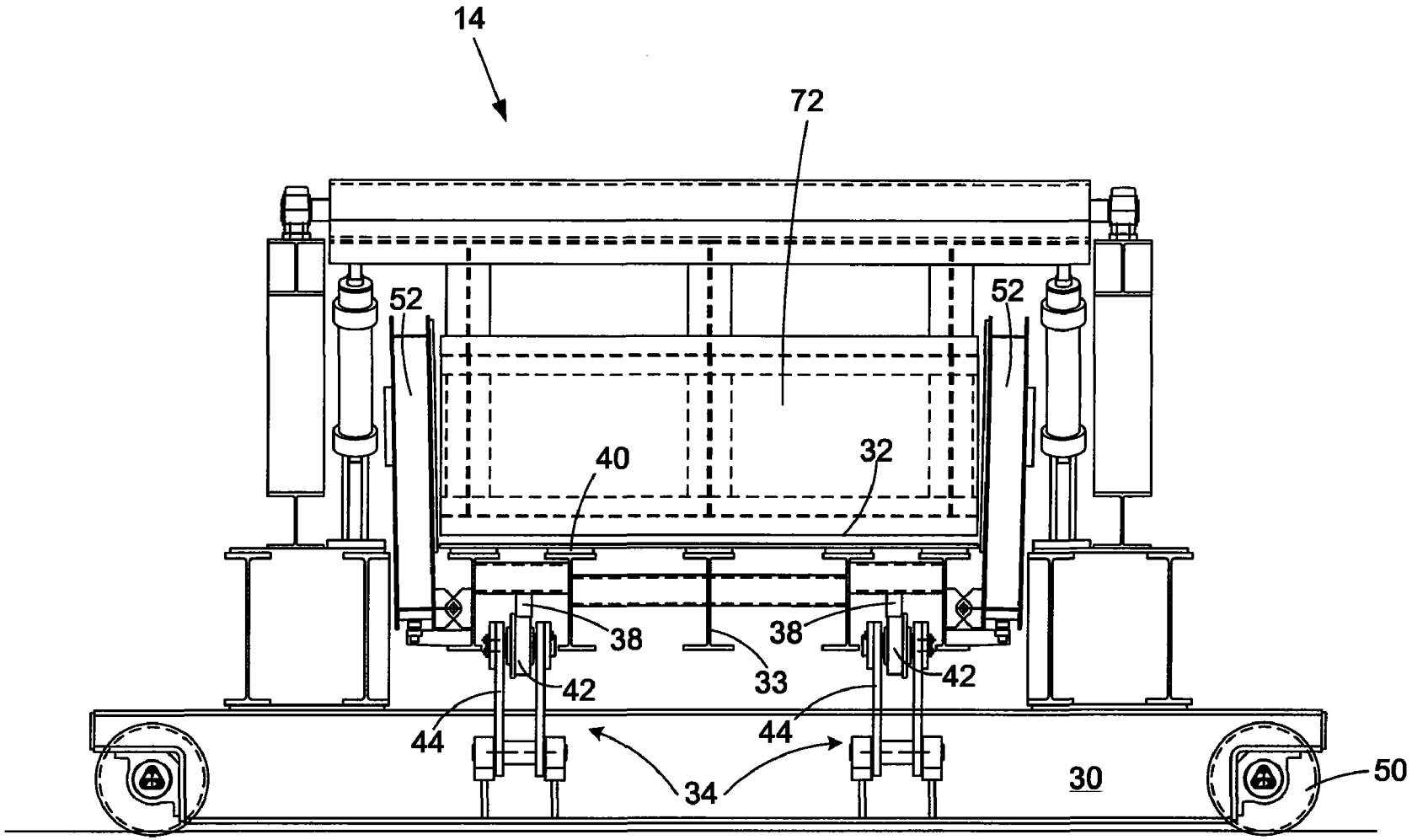
FIG. 3 is elevational end view, not to scale, of a charge car device according to an embodiment of the disclosure.
Figure 4:
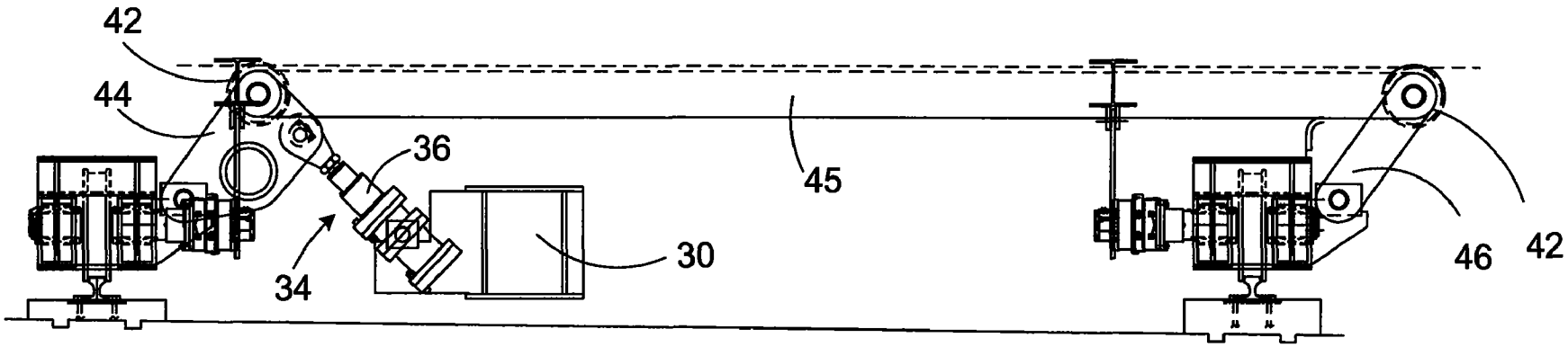
FIG. 4 is an enlarged side view, not to scale, of a height adjustment mechanism according to an embodiment of the disclosure.

Details of portions of the height adjustment mechanism 34 for raising and lowering the transfer plate 32 are provided in FIGS. 3 and 4. FIG. 3 is an end view of the charge car device 14 showing the height adjustment mechanism 34 attached to the frame 30 and FIG. 4 is an enlarge side view of the height adjustment mechanism 34. The actuator 36 is attached to the frame 30 and to a first pivot arm 44 holding wheels 42. The first pivot arm 44 is mechanically linked, as by a rod 45 or other rigid linking device, to a distal pivot arm 46 (FIG. 4) that moves in conjunction with the first pivot arm 44 by action of the connecting rod 45. Each of the first pivot arm 44 and distal pivot arm 46 is pivotally attached to the frame 30.

Upon activation of the actuator 36, the pivot arms 44 and 46 are raised or lowered thereby raising or lowering the rails 38 supporting the transfer plate 32. The wheels 42 enable movement of the rails 38 and transfer plate 32 toward or away from the oven 12 as needed to properly position the charge car device 14 relative to an oven 12 to be charged.

Due to oven height disparities relative to a reference height of the rails 24, the height adjustment mechanism 34 may be used to provide the transfer plate 32 at a desired elevation for translatable movement into the oven 12 to be charged with coal. Variations in oven height typically range from about one to about five inches. Accordingly, the height adjustment mechanism 34 should be capable of moving and holding the transfer plate 32 at an elevation that may vary over a range of from one inch to five inches from a reference elevation of the transfer plate 32. It will be appreciated that height elevations ranges that may be needed for a particular oven battery may range more than from about one to about five inches. In addition to height adjustment of the transfer plate 32, the transfer plate 32, bearing rails 38, and bearing rolls 40 may be telescoped toward the oven 12 for oven charging and away from the oven for movement of the charge car device along rails 24 while clearing other oven structures. A separate actuator may be used to move the rails 38 and transfer plate 32 toward and away from the oven.

The frame 30 of the charge car device 14 includes wheels 50 for a positioning the charge car device 14 along rails 24 to adjacent the coal charge end 20 of the oven 12 to be charged with compacted coal. The wheels 50 also enable the charge car device 14 to be positioned in the coal charging station 25 and the coal compaction station 18, described in more detail below.

Tiltable side walls 52 are provided along a length of the transfer plate 32. The tiltable side walls 52 may be rotated away from compacted coal on the transfer plate 32 when the transfer plate 32 and compacted coal thereon are being moved into the oven 12. Rotating the tiltable side wall 52 away from the compacted coal provides reduced friction between the side walls 52 and the compacted coal.

Figure 5:
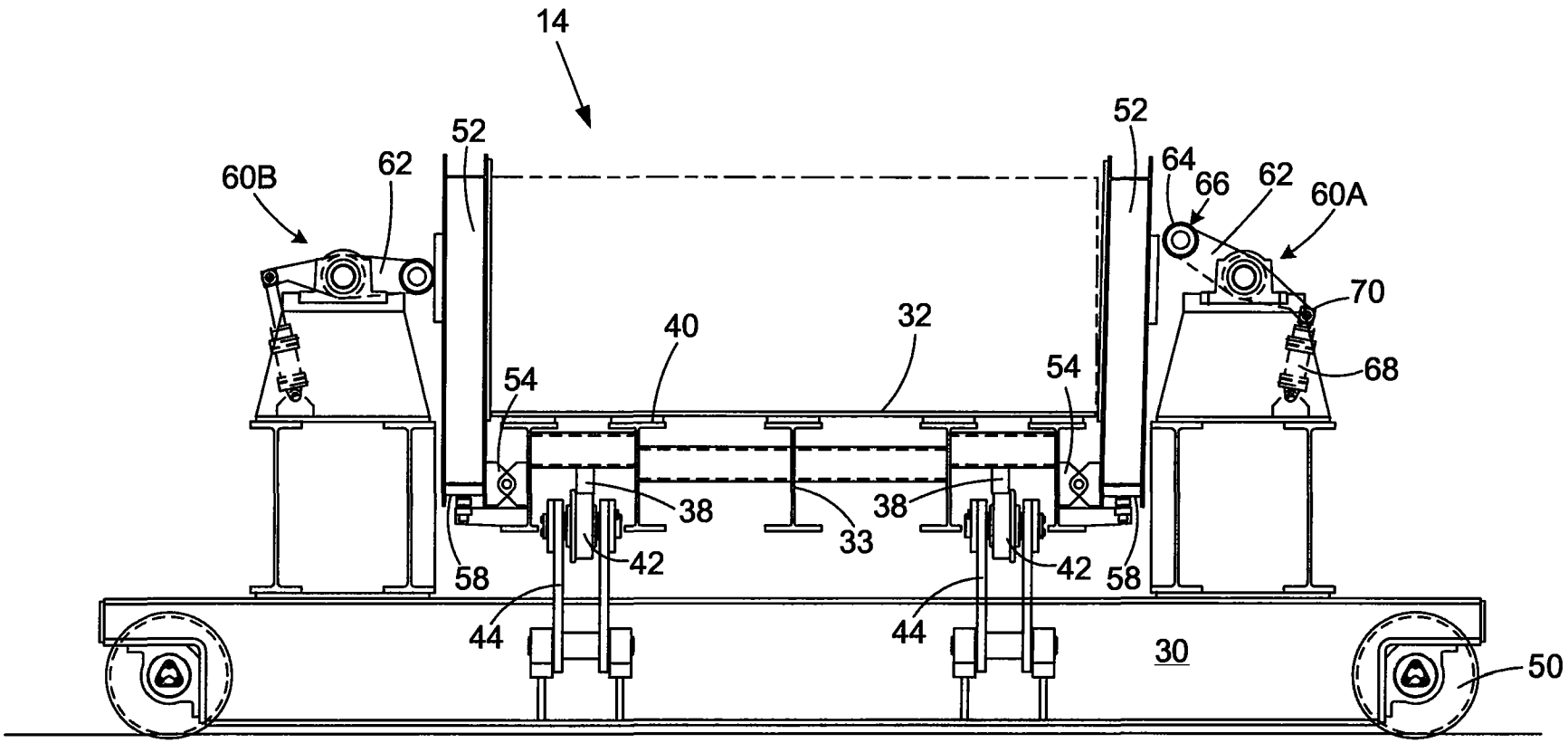
FIG. 5 is an elevational section view, not to scale, of a charge car device according to an embodiment of the disclosure.

As shown in FIG. 5, the tiltable side walls 52 are pivotally adjacent a first end 58 thereof to wall support members 54 and may be released from contact with the compacted coal or locked against movement as shown and described. Locking mechanisms 60A and 60B may be used in conjunction with the tiltable side walls 52 to prevent the tiltable side walls 52 from moving during a coal compaction process. Each locking mechanism 60A and 60B includes a pivot arm 62 having a roller 64 adjacent a first end 66 thereof and an actuator mechanism 68 adjacent a second end 70 thereof. Locking mechanism 60A is shown in a first unlocked position and locking mechanism 60B is shown in a second locked position in FIG. 5.

Figure 6:
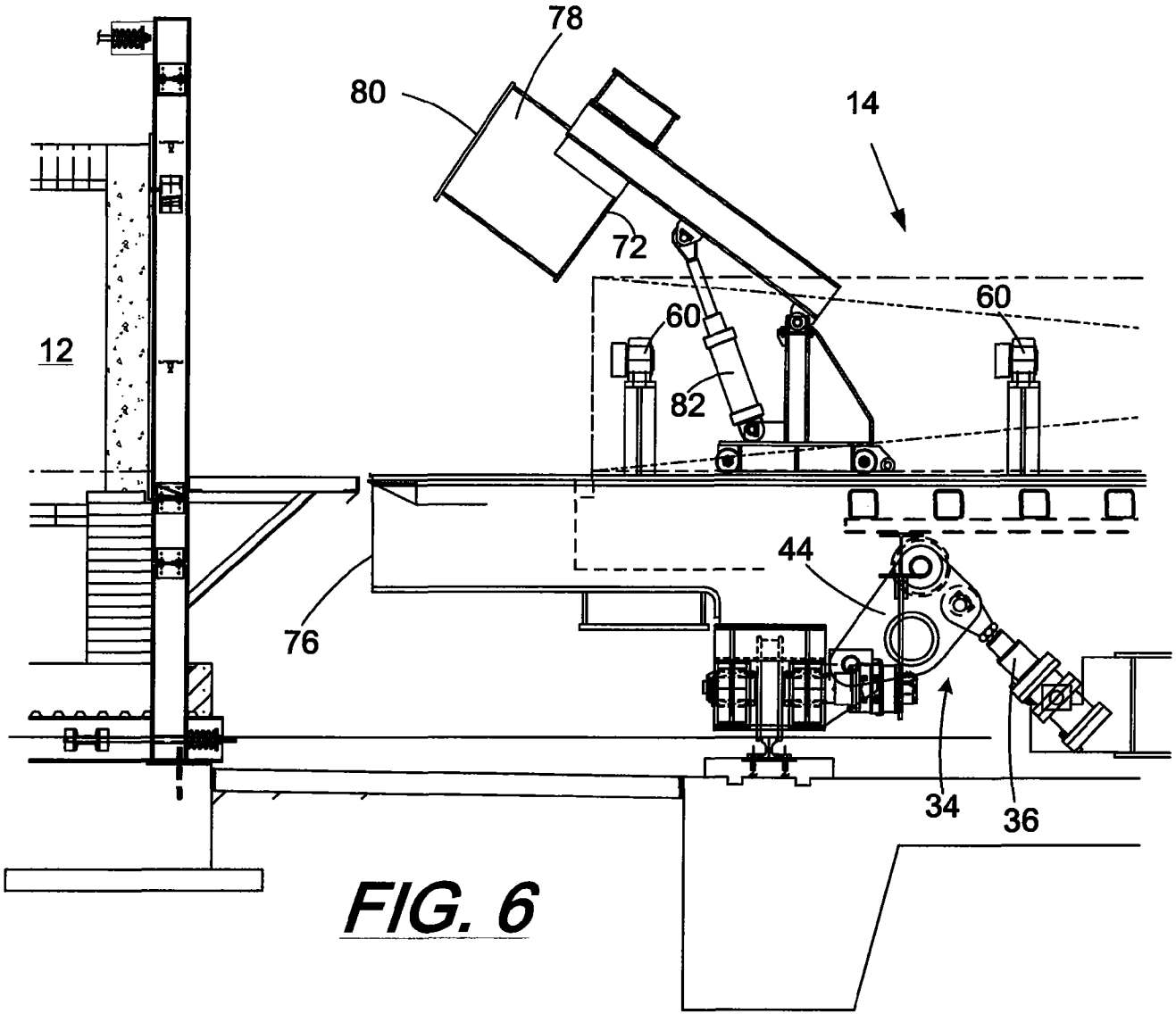
FIGS. 6-7 are elevational side views, not to scale, of a portion of a charge car device according to an embodiment of the disclosure for a coal charging operation.
Figure 7:
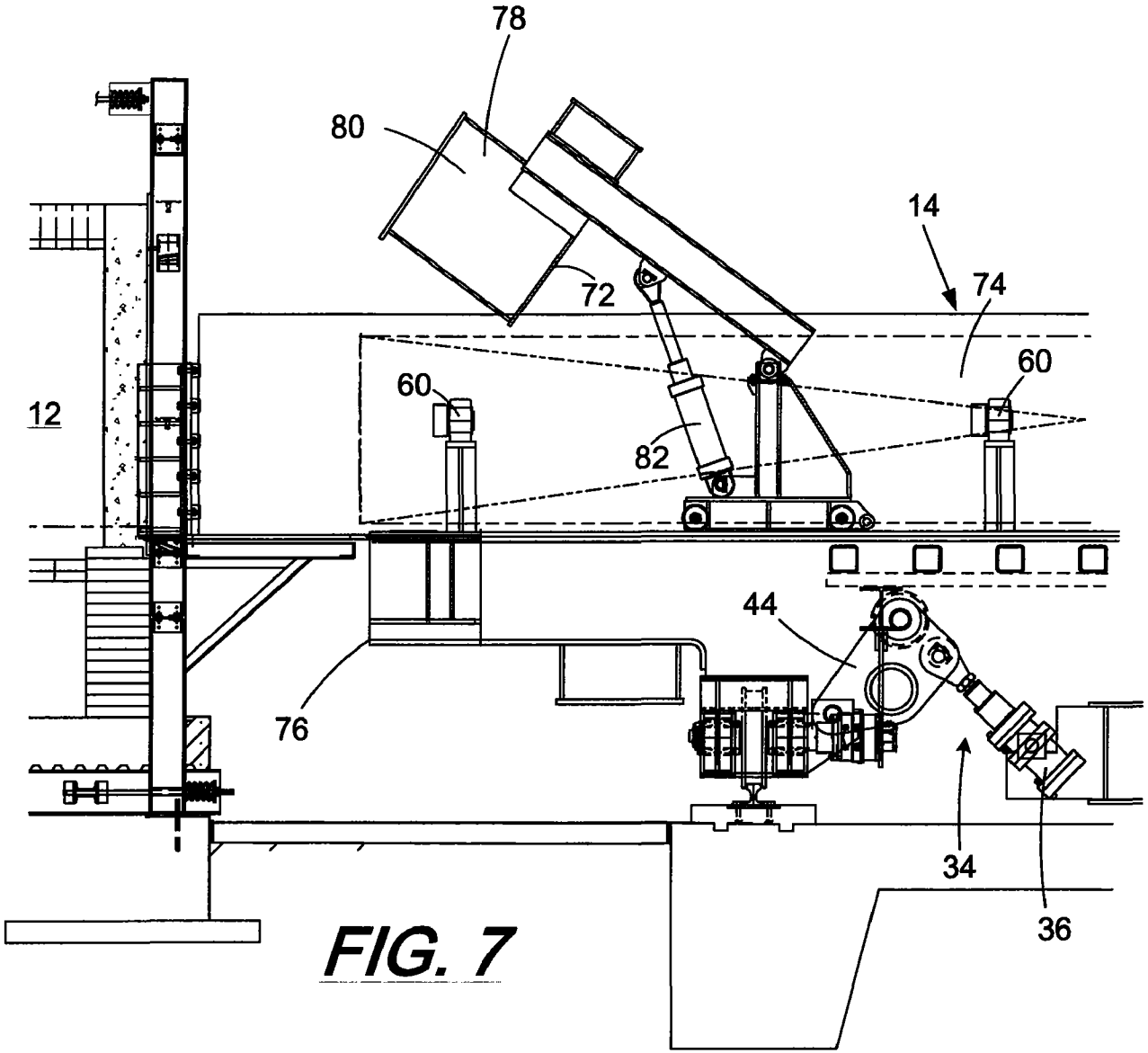
Figure 8:
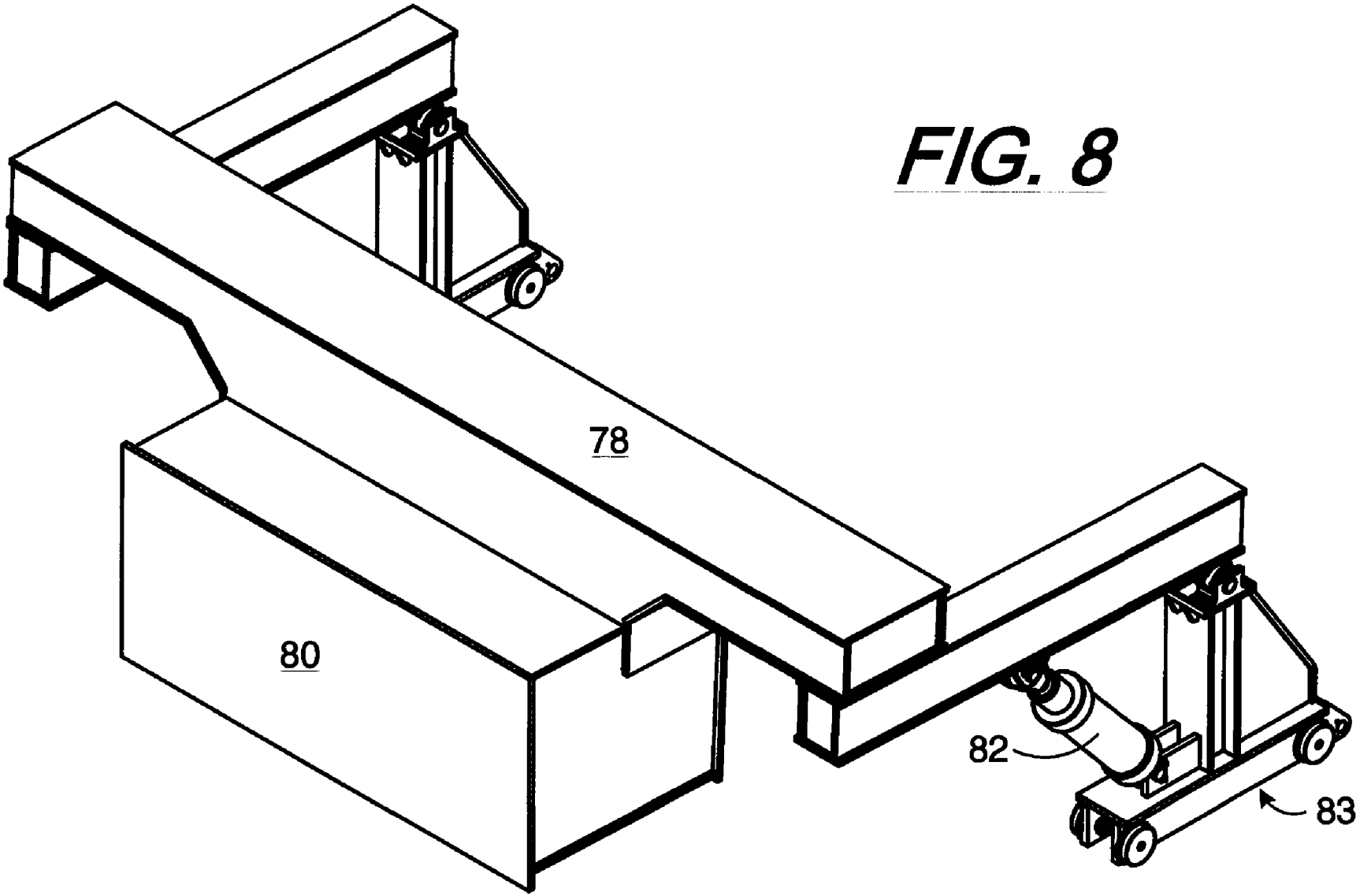
FIG. 8 is a perspective view, not to scale, of a backstop and ram device according to an embodiment of the disclosure.

At least one end 76 of the charge car device 14 includes a movable end wall 72 and a ram head 80 attached to opposite sides of a ram head device 78 as shown in more detail in FIG. 6. The back stop device 78 containing the movable end wall 72 and ram head 80 may be rotated in a downward position for loading coal and compacting coal on the transfer plate 32. When the back stop device 78 is rotated in the upward position as shown in FIG. 6, the transfer plate 32 and compacted coal 74 thereon may be translated into the oven 12 to charge the oven.

Figure 9:
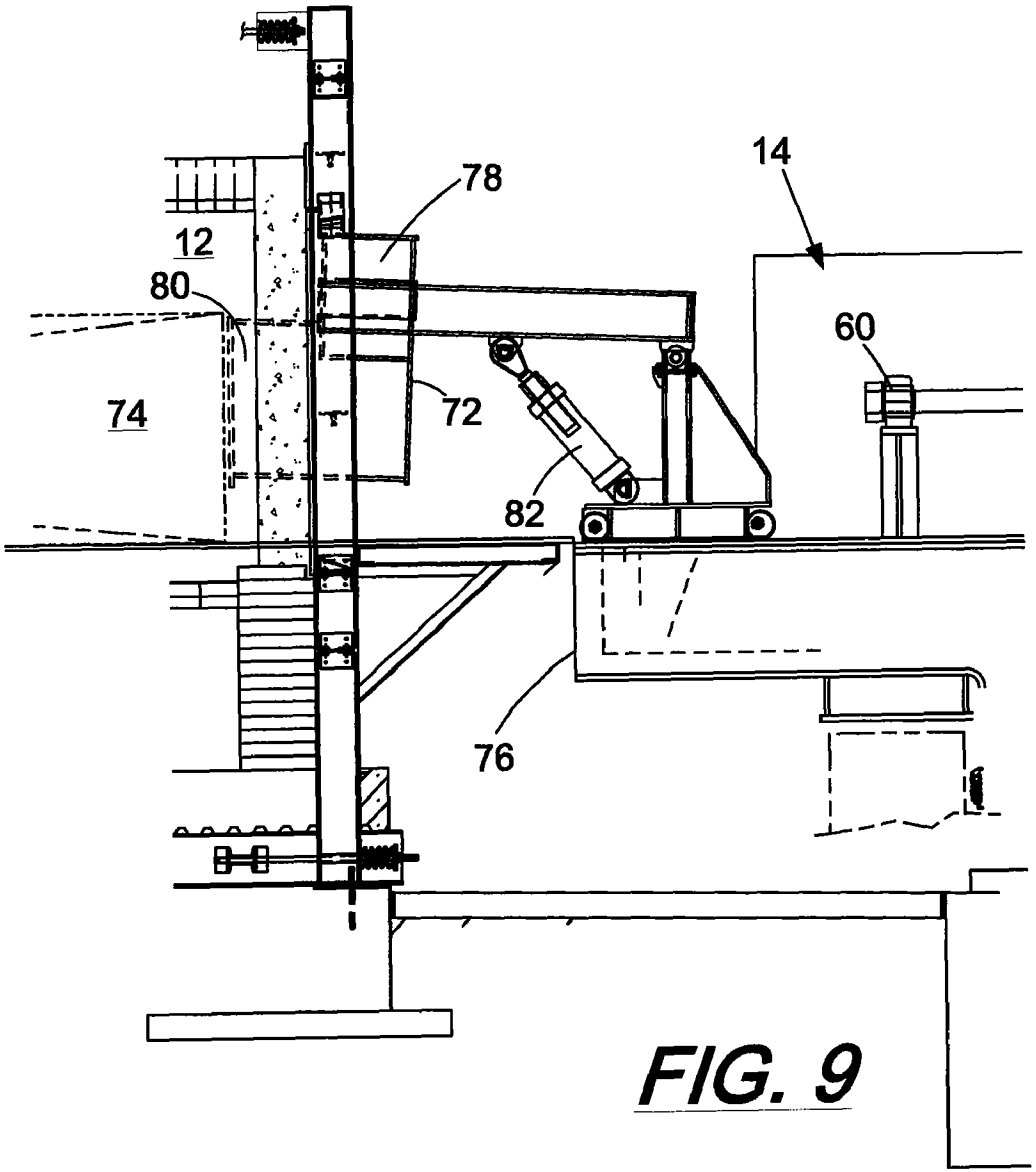
FIGS. 9-10 are elevational side views, not to scale, of a portion of a charge car device according to an embodiment of the disclosure after a coal charging operation.
Figure 10:
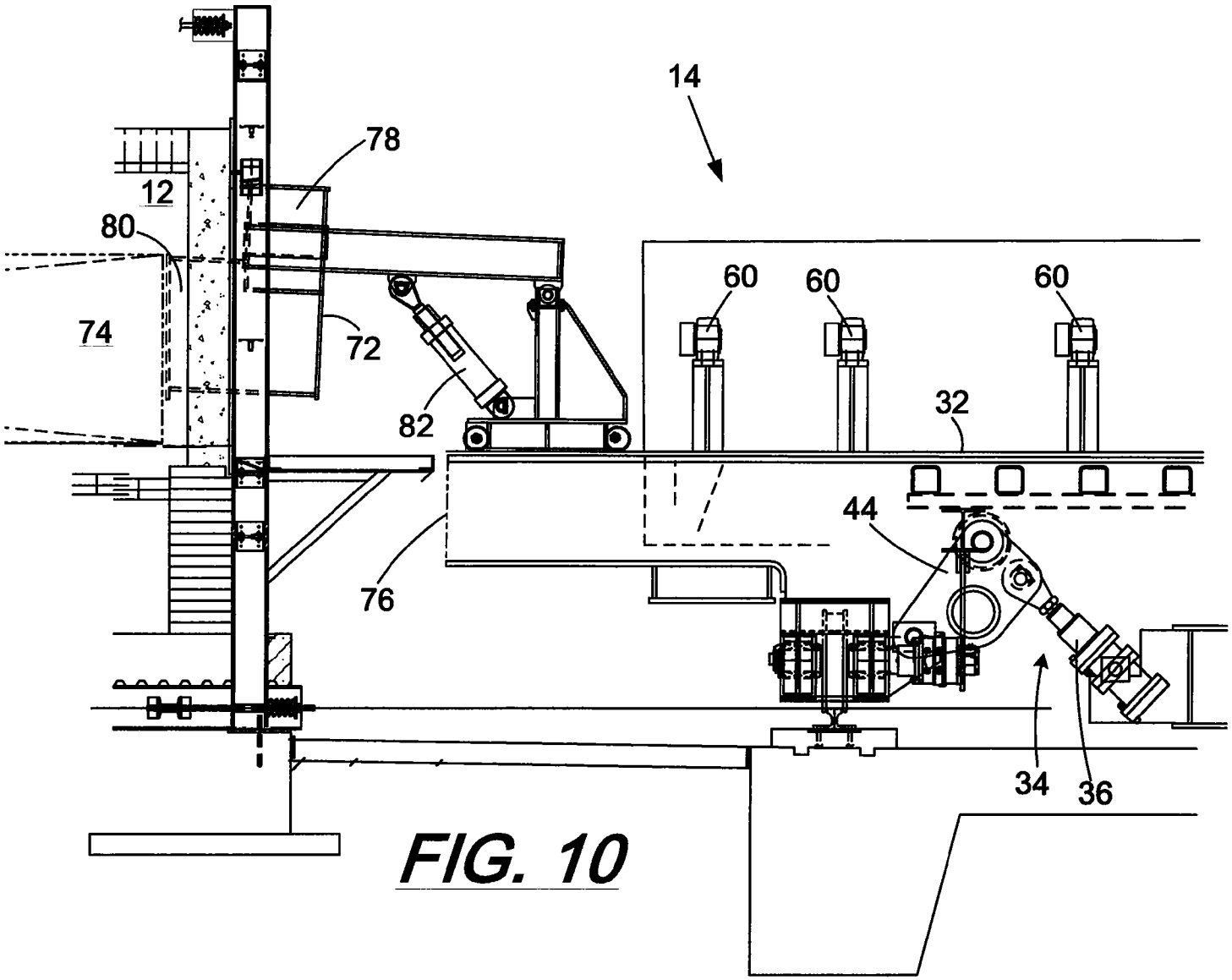

During the oven charging step, the back stop device 78 (FIGS. 7 and 8) containing a ram head 80 may be rotated upward, as by actuator 82 so that the compacted coal 74 may be moved into the oven 12. Once the oven 12 is charged with compacted coal 74, the backstop device 78 may be rotated downward, as by actuator 82, and may be moved toward the oven, as by trolley mechanism 83 to place the ram head 80 inside the oven 12 adjacent the compacted coal 74 to hold the compacted coal 74 in the oven 12 while the transfer plate 32 is being withdrawn from the oven 12 as shown in FIGS. 9 and 10. After the transfer plate 32 has been withdrawn from the oven, the backstop device 78 is rotated upward and is then moved using the trolley mechanism 83 to the position shown in FIG. 6.

Figure 11:
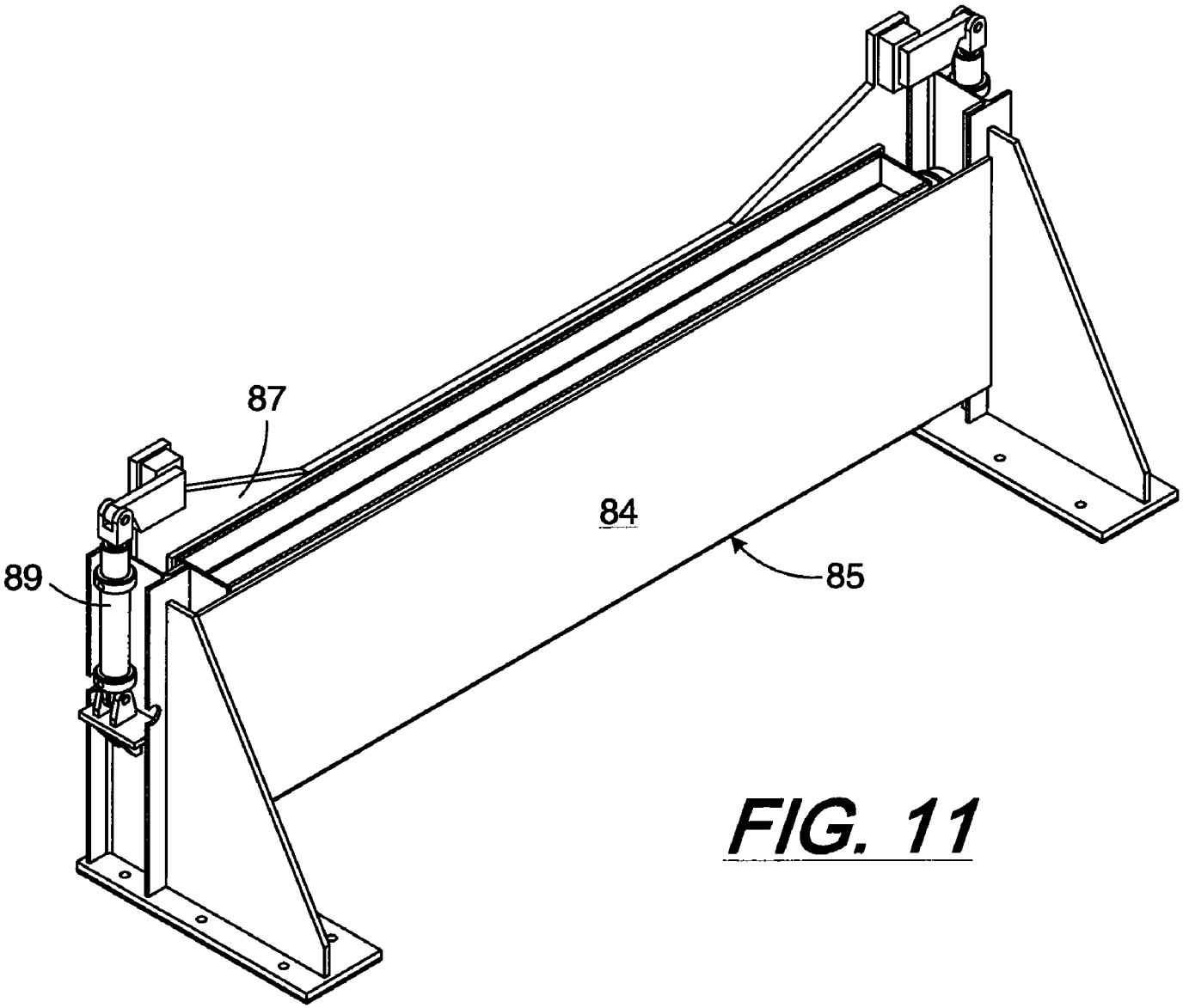
FIG. 11 is a perspective view, not to scale, of an adjustable end wall for a charge car device according to the disclosure.
Figure 12:
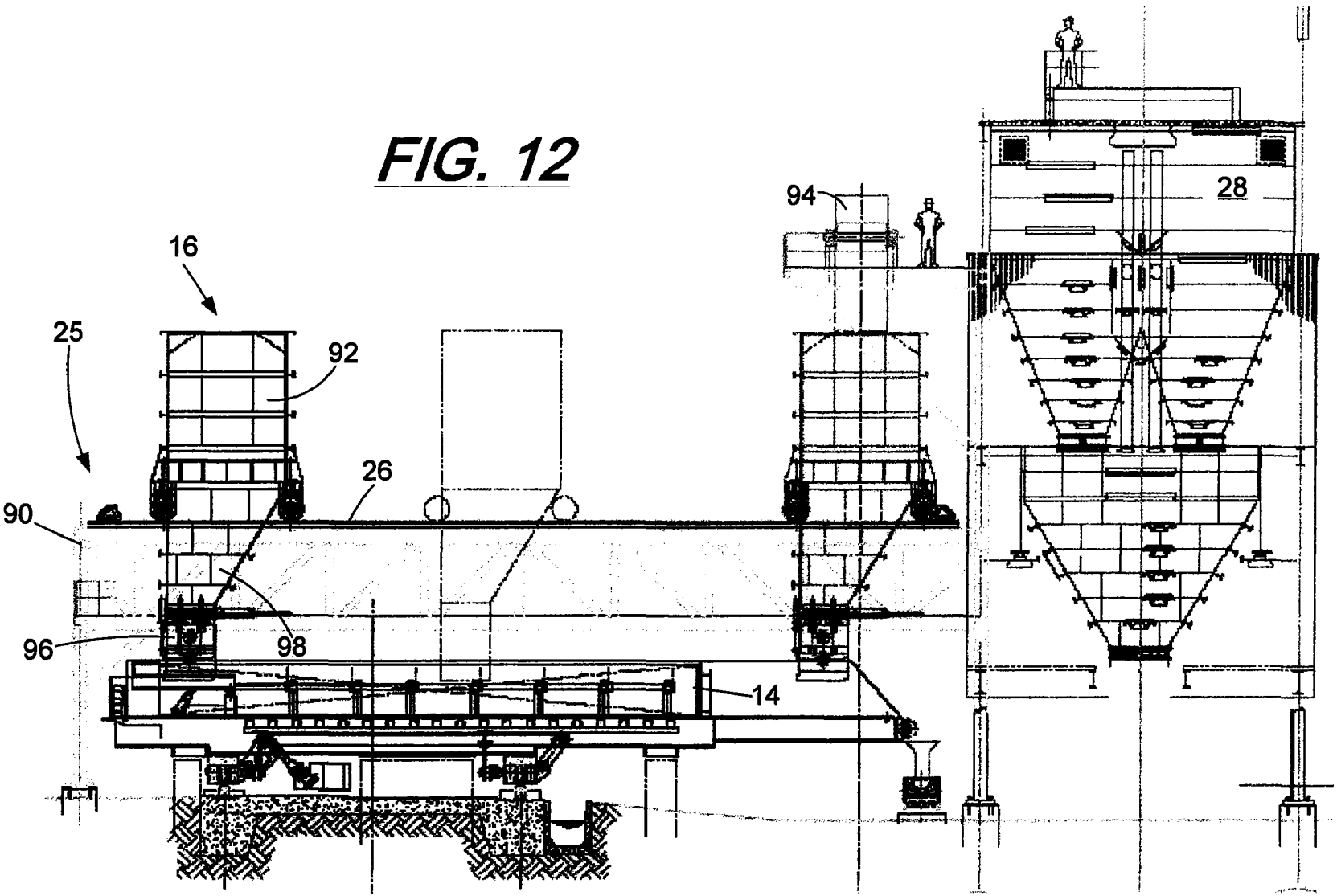
FIG. 12 is an elevational side view, not to scale, of a coal filling station according to an embodiment of the disclosure.

An opposing end of the transfer plate 32 includes an end wall 84 that may be stationary or vertically movable. In one embodiment, the end wall 84 may be adjusted up or down to clear a telescoping chute 96 on the coal filling apparatus 16 (FIG. 12). Details of the adjustable end wall 84 are illustrated in FIG. 11. The adjustable end wall 84 has a stationary section 85 attached to the frame 33 and a movable section 87 that may be raise and lowered by an actuator mechanism 89.

The transfer plate 32 may be translated into and out of the oven 12 using a combination of a heavy duty, high speed chain and sprocket system 86 with a chain connected to a distal end 88 of the transfer plate 32 for movement of the transfer plate 32 along bearing rolls 40 attached to bearing rails 38 (FIG. 2). During a coal charging operation, the chain and sprocket system 86 moves a portion of the transfer plate 32 into the oven 12 so that the compacted coal may be deposited on a floor surface of the oven when the transfer plate 32 is retracted from the oven. The transfer plate 32 has a thickness typically ranging from about 1.5 to about 3 inches and is preferably made of cast steel.

As with the compacted coal charging device described in U.S. Pat. No. 6,290,494 to Barkdoll, the disclosure of which is incorporated herein by reference, the charge car device 14 described herein may optionally include an uncompacted coal chamber for providing an insulating layer of uncompacted coal between the transfer plate 32 and the oven floor as the transfer plate 32 moves into the oven 12. The uncompacted coal layer may insulate the transfer plate 32 from the radiant heat of the oven floor and may provide a relatively smooth, level surface for movement of the transfer plate 32 into and out of oven 12. The weight of the compacted coal 74 and transfer plate 32 is sufficient to compress the uncompacted coal to increase its density above that of uncompacted coal.

With reference now to FIG. 12, the coal filling apparatus 16 for filling the charge car device 14 is illustrated. The coal filling apparatus 16 includes an elevated rail structure 90 for rails 26 and a weigh bin 92 that is movable in a direction substantially orthogonal to rails 24 for filling the charge car device 14 substantially evenly with a predetermined amount of coal. The rails 26 also enable the coal filling apparatus 16 to be positioned adjacent a coal storage bin 28 for refilling the weigh bin 92 with the predetermined amount of coal. A cross conveyor 94 provides flow of coal from the storage bin 28 to the weigh bin 92. The weigh bin 92 is large enough to hold about 50 to 60 metric tons of coal particles.

A telescoping chute and leveling device 96 is provided on a discharge end 98 of the weigh bin 92 to substantially evenly fill the charge car device 14 with uncompacted coal. As the weigh bin 92 traverses from one end of the charge car device 14 to the other end of the charge car device 14 along rails 26, coal is metered into the charge car device 14 and smoothed to provide a substantially planar surface for the compaction process. The telescoping chute has a profile that provides a "batwing profile" of coal across a width of the transfer plate 32. By "batwing profile" is meant that a depth of uncompacted coal adjacent the side walls 52 is greater than a depth of coal across a substantial portion of the width of the transfer plate 32.

Coal suitable for forming metallurgical coke is typically ground so that at least about 80% has an average size of less than about 3 millimeters as determined by standard screen analysis procedures. The uncompacted coal also has a moisture value ranging from about 6 to about 10 percent by weight and a bulk density ranging from about 640 to about 800 kilograms per cubic meter. As deposited on the transfer plate 32, the uncompacted coal it typically about 50 to 60 percent by volume coal particles and about 40 to about 50 percent by volume voids.

Figure 13:
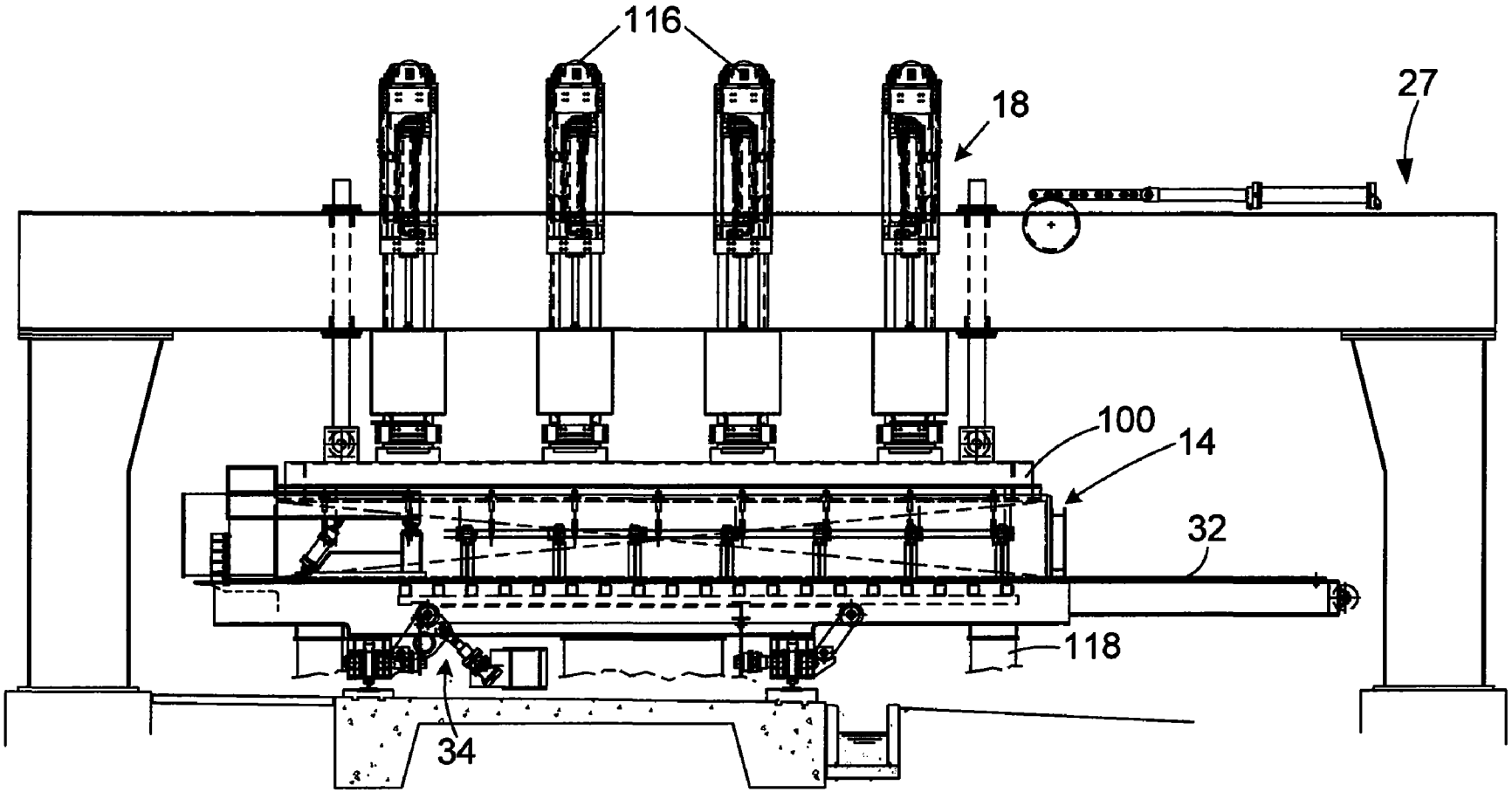
FIG. 13 is an elevational side view, not to scale, of a coal compaction station according to an embodiment of the disclosure.
Figure 14:
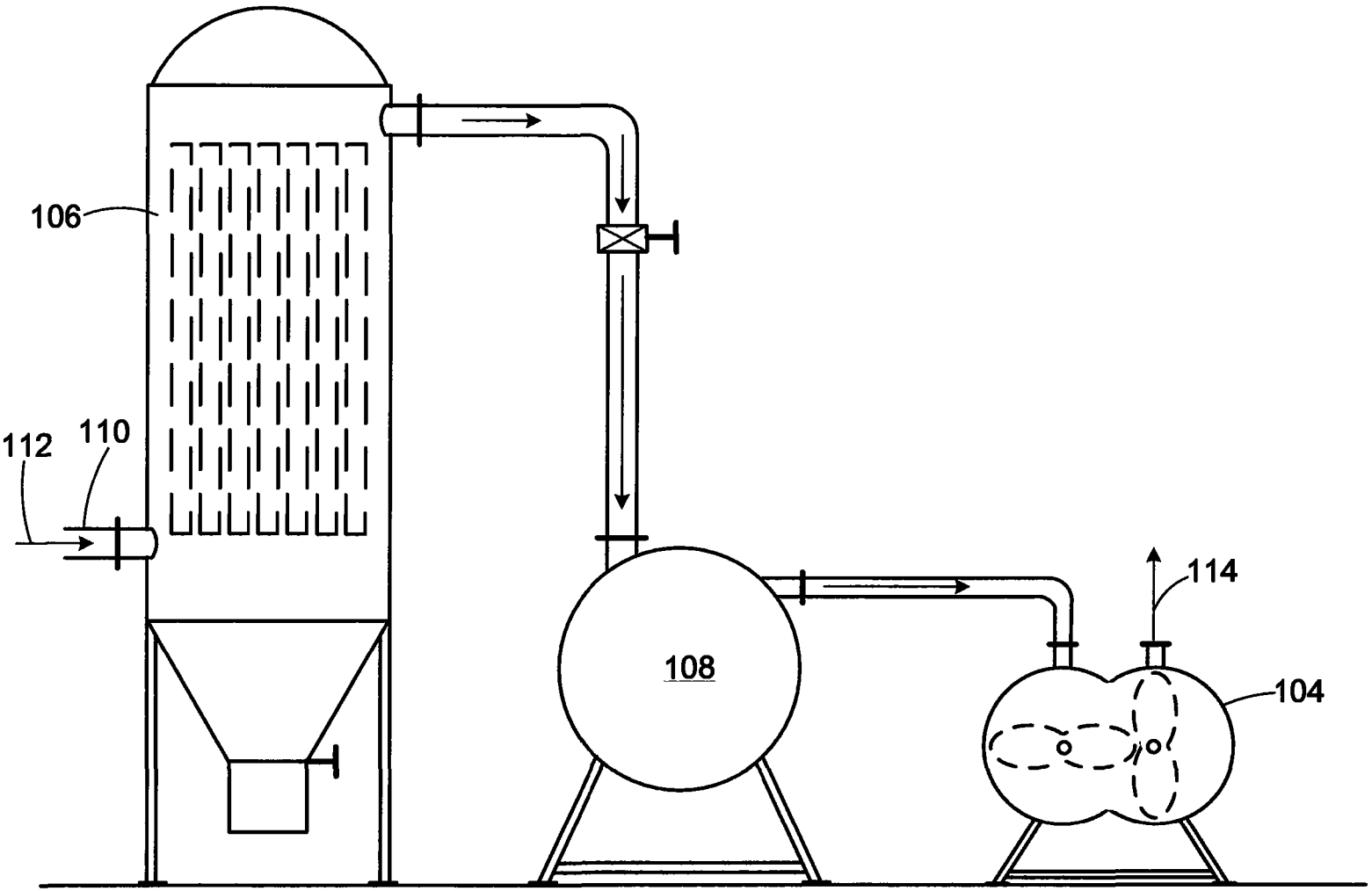
FIG. 14 is a schematic view of a vacuum pump and dust collection system for the coal compaction station of FIG. 11.
Figure 15:
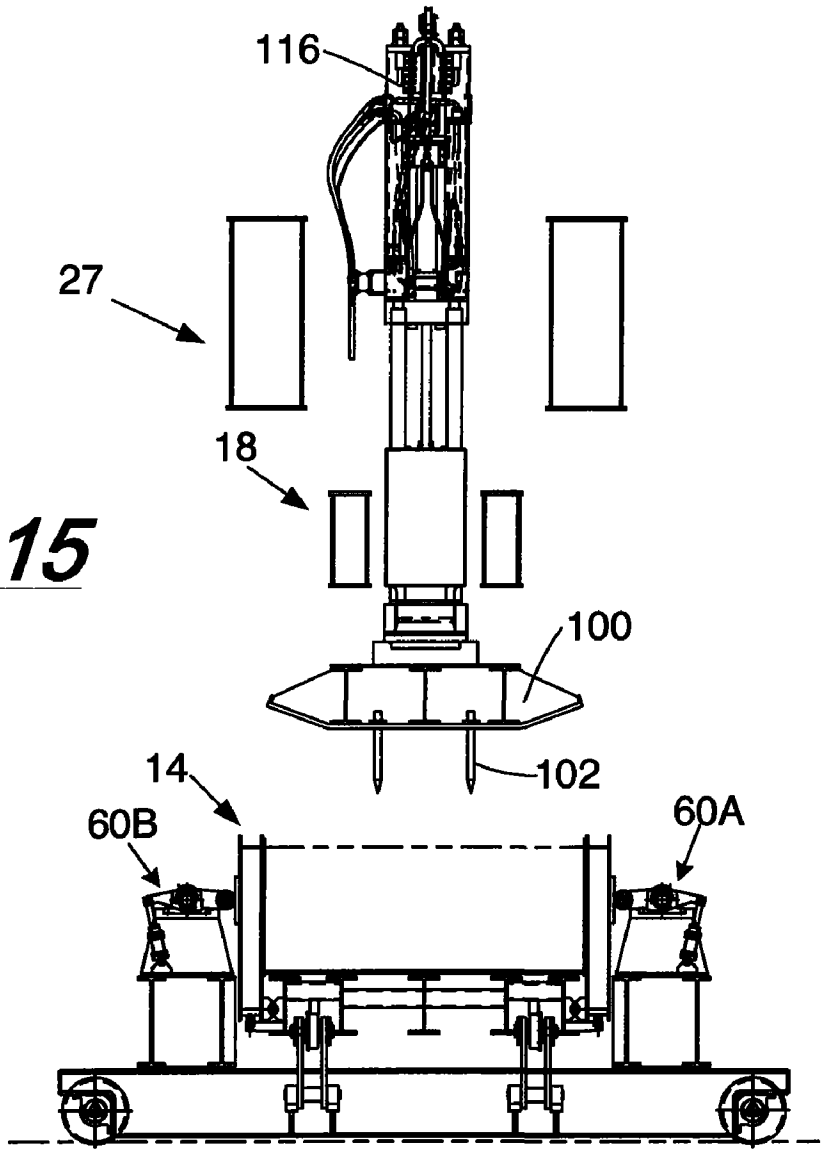
FIG. 15 is an elevational end view, not to scale, of a portion of the coal compaction station of FIG. 13.

After filling the charge car device 14 with the predetermine amount of coal, typically about 45 to about 55 metric tons of coal, the charge car device 14 is transported to the compaction station 27 for compacting the coal. The compaction station 27 includes the compaction apparatus 18 for rapidly compacting the coal in the charge car 14 (FIGS. 13-15). The compaction apparatus 18 includes a pressure plate 100, that may be a single plate having a length substantially the same as a length of the uncompacted coal bed on the transfer plate, or the pressure plate 100 may be provided by multiple plates spanning the length of the uncompacted coal bed. The pressure plate 100 is lowered onto the uncompacted coal in the compaction station 27. As shown in FIG. 15 the compaction plate 100 has the same batwing profile as the uncompacted coal.

Disposed at spaced intervals on the compaction plate 100 are a plurality of degassing probes 102 that extend into the uncompacted coal bed up to about 80 percent of the depth of the uncompacted coal bed to provide degassing of the uncompacted coal during the compaction process. Suitable probes 102 may be provided by perforated screen pipe having a nominal diameter of about 5 centimeters and a length of about 60 centimeters. The probes are spaced apart from one another about 120 centimeters, center to center, throughout the uncompacted coal bed.

The probes 102 may be vented to the atmosphere, or may be connected in gas flow communication with a vacuum pump 104 and dust collection system 106 as shown in FIG. 14. During the compaction process, the vacuum pump 104 may apply a vacuum ranging from about 185 to about 280 mm Hg on the probes 102 to remove entrained air from the uncompacted coal bed during the compaction process. Volumetric flow rate of gas during the compaction process for may range from about 50 cubic meters per minute to about 85 cubic meters per minute. A vacuum reservoir vessel 108 may be used to provide a short duration vacuum source for degassing the coal during the compaction process.

Gases collected from the coal bed flow to the dust collection system 106 through a conduit 110 as indicated by arrow 112. Clean exhaust gases flow from the vacuum pump 104 to the atmosphere as indicated by arrow 114.

An advantage of using a vacuum pump 104 and dust collection system 106 during the compaction process is that any dust which may form during the compaction process may be collected in a dust collection system 106 rather than venting to the atmosphere. Another advantage of using a vacuum pump 104 during the compaction process is that a moisture content of the coal may be reduced whereby less energy may be required for coking the coal.

Another component of the compaction apparatus 18 is one or more pile driver devices 116 which are effective to apply an impact pressure to the pressure plate 100 to more rapidly compact the coal. Because the coal bed is degassed during the compaction process, the pile driver devices 116 need only apply from about two to about 3.5 kilogram-force meter/kilogram of coal to compact the coal to the desired bulk density. Prior art devices for coal compaction typically require over 3.5 kilogram-force meter/kilogram of coal to provide similar high bulk density coal.

In order to reduce shock waves from being transmitted though the wheels 50 and rails 24, support piers 118 may be provided in the compaction area 27 for supporting the charge car device 14. Accordingly, the height adjustment mechanism 34 may be actuated to lower the charge car device 14 from about 2 to about 6 centimeters so that the frame 33 (FIG. 3) of the charge car device 14 is supported mainly by the piers 118 rather than the wheels 50 and frame 30.

The compaction apparatus 18 described above may be sufficient to compact a deep bed of coal in less than about three minutes, and may be sufficient to compact a deep bed of coal in less than about 30 seconds, such as in about 15 second. By "deep bed" is meant an uncompacted coal bed having a depth ranging from about 135 to about 145 centimeters deep. The compaction apparatus 18 described herein may provide substantially uniformly compacted coal through the depth of the coal bed. Prior art compaction processes typically provide non-uniform compaction of coal through the depth of the coal bed.

Typical cycle times for filling the charge car 14 with about 52 metric tons of coal and compacting the coal to a target bulk density of about 1040 kilograms per cubic meter are provided in the following table.

TABLE 1

| Step No. | Step Description | Time (seconds) |
|---|---|---|
| 1 | Telescoping Coal Fill Chute Lowered Into Car | 10 |
| 2 | Charge Car Filled With Coal (14 meters long) | 45 |
| 3 | Retract Telescoping Coal Fill Chute | 10 |
| 4 | Move Car And Spot Car In Compaction Station | 25 |
| 5 | Lower Pressure Plate To Uncompacted Coal | 10 |
| 6 | Turn On Vacuum And Cycle Pile Drivers (5 X) | 30 |
| 7 | Retract Pressure Plate From Compacted Coal | 15 |
| | Total Time | 2 min. 25 Sec. |

It will be appreciated that the entire process of filling and compacting coal using the impact and degassing system described above may be achieved in less than about 3 minutes for the amount of uncompacted coal and the targeted bulk density provided in this example.

Figure 16:
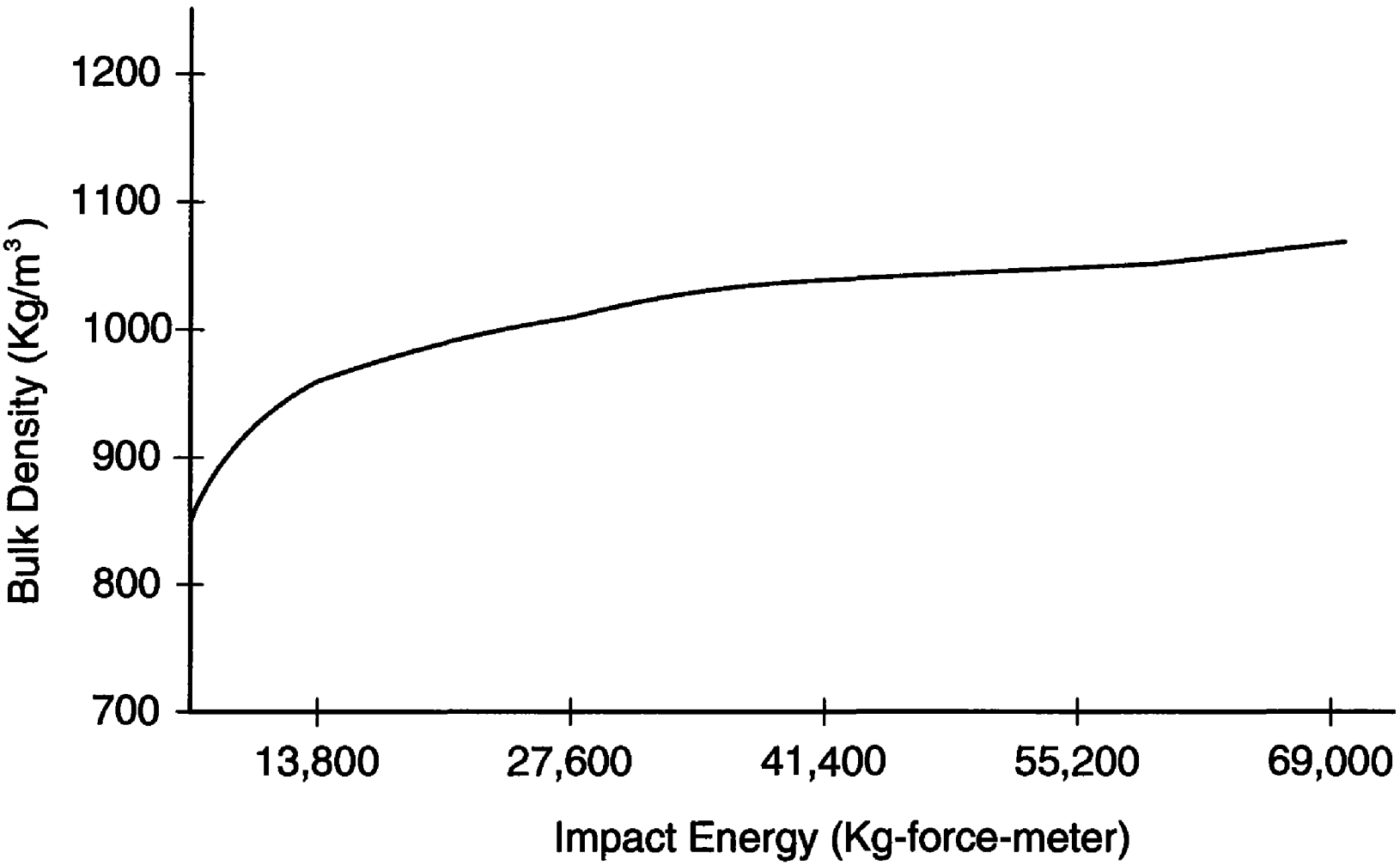
FIG. 16 is a graphical illustration of bulk density versus impact energy for coal compacted using the methods and apparatus of the disclosed embodiments.

In the following example a compaction test on 13 metric tons of coal was conducted to determine the resulting depth and bulk density of the compacted coal after impacting the uncompacted coal bed multiple times while venting air from the coal bed using the probes 102 described above. The uncompacted coal bed was placed in a 365 centimeter square box at an initial depth of 129 centimeters. Multiple impacts of 13,800 kilogram-meters were applied in each impact. The pressure plate 100 and pile driver weighed a total of 23 metric tons. The results are shown in the following table and in FIG. 16.

TABLE 2

| Activity | Coal Depth (cm) | Bulk Density ($kg/m^3$) |
|---|---|---|
| Coal in box (13 metric tons) | 129 | 761 |
| Pressure plate placed on box (4 metric tons) | 126 | 775 |
| Pile driver and pressure plate (23 metric tons) | 115 | 853 |
| After first impact (13,800 kilogram-meters) | 102 | 960 |
| After second impact (13,800 kilogram-meters) | 97 | 1013 |
| After third impact (13,800 kilogram-meters) | 94 | 1040 |
| After fourth impact (13,800 kilogram-meters) | 93 | 1056 |
| After fifth impact (13,800 kilogram-meters) | 91 | 1072 |

In the foregoing description, the entire apparatus with the exception of conveyor belts, electrical components and the like may be made of cast or forged steel. Accordingly, robust construction of the apparatus is possible and provides a relatively long lasting apparatus which is suitable for the coke oven environment.

The apparatus and methods described above enable use of less costly coal for metallurgical coke production thereby reducing the overall cost of the coke. Depending on the particular coal source and the level of compaction achieved, a compacted coal charge made according to the invention may include up to about 80 wt. % non-coking coal. The amount of coke produced by the apparatus of the invention may also be increased from 30 to 40 metric tons up to about 45 to about 55 metric tons as a result of the compaction process. More consistent coal charge physical parameters such as coal charge height, width and depth are also a benefit of the apparatus and methods according to the invention.

It is contemplated, and will be apparent to those skilled in the art from the preceding description and the accompanying drawings that modifications and/or changes may be made in the embodiments of the disclosure. Accordingly, it is expressly intended that the foregoing description and the accompanying drawings are illustrative of exemplary embodiments only, not limiting thereto, and that the true spirit and scope of the present disclosure be determined by reference to the appended claims.

What is Claimed is:

1. A relatively high speed method for increasing the bulk density of coal particles to provide an elongate bed of dry, compacted coal for charging to a coking oven, the method comprising the steps of:

depositing coal particles onto a charging plate external to a coking oven, the charging plate having side walls, and at least one movable end wall to provide an elongate bed of dry, uncompacted coal having an upper surface on the charging plate; and applying impact pressure to the upper surface of the bed of dry, uncompacted coal while degassing the coal to provide a dry, compacted coal bed having a bulk density ranging from about 960 to about 1200 kilograms per cubic meter, wherein degassing the coal is selected from the group consisting of applying a vacuum source to one or more probes inserted into the uncompated coal bed and venting air through one or more probes inserted into the uncompated coal bed.

2. The method of claim 1, wherein degassing the coal bed is comprised of applying a vacuum source to one or more probes inserted in the uncompacted coal bed.

3. The method of claim 2, wherein the vacuum source provides a vacuum to the uncompacted coal bed ranging from about 185 to about 280 mm of Hg during the degassing step.

4. The method of claim 1, wherein degassing the coal bed comprises venting air through one or more probes inserted into the uncompacted coal bed.

5. The method of claim 1, wherein the coal particles are compacted to the bulk density ranging from about 960 to about 1200 kilograms per cubic meter from an initial bulk density ranging from about 640 to about 800 kilograms per cubic meter in less than about three minutes.

6. The method of claim 1, wherein the impact pressure ranges from about two up to about 3.5 kilogram-force meter/kilogram of coal.

7. The method of claim 1, further comprising applying from about one to about five impacts to the upper surface of the coal bed.

8. A method for making metallurgical coke from coal, comprising charging a coking oven with the dry, compacted coal bed made by the method of claim 1 and heating the coal at a temperature and for a period of time under a reducing atmosphere to provide metallurgical coke.

9. Metallurgical coke made by the method of claim 8.

10. A coal compacting and coke oven charging apparatus comprising:

a coal bed charge car comprising a transfer plate having side walls, at least one movable end wall, and a transfer plate translating mechanism for transportation compacted coal into the coke oven; and a coal compaction device comprising:

a pressure plate for applying pressure to an upper surface of a dry, uncompacted bed of coal deposited on the transfer plate; and a vacuum source for degassing the uncompacted bed of coal to provide a dry, compacted coal bed having a bulk density ranging from about 960 to about 1200 kilograms per cubic meter.

11. The coal compacting and coke oven coal charging apparatus of claim 10, wherein the coal compaction device further comprises a ram for applying an intermittent impact force to the pressure plate.

12. The coal compacting and coke oven coal charging apparatus of claim 10, further comprising perforated probes attached to the pressure plate for degassing the uncompacted bed of coal during a compaction process.

13. The coal compacting and coke oven coal charging apparatus of claim 10, further comprising a pier for supporting the charge car during a compaction process.

14. The coal compacting and coke oven coal charging apparatus of claim 10, further comprising a backstop device attached adjacent to the at least one movable end wall for retaining compacted coal in the coke oven while withdrawing the transfer plate from the oven.

15. The coal compacting and coke oven coal charging apparatus of claim 10, wherein the charge car further comprises a height adjustment mechanism for adjusting a height of the transfer plate during a coke oven compacted coal charging process.

16. The coal compacting and coke oven coal charging apparatus of claim 10, further comprising a coal depositing and leveling device for depositing uncompacted coal into the charge car, the coal depositing and leveling device comprising a telescoping chute and coal weigh bin in flow communication with the chute for deposited a predetermined amount of coal into the charge car and for leveling the uncompacted coal on the transfer plate.

17. A method for operating a horizontal non-recovery coke oven using a relatively low quality coal source, the method comprising the steps of:

depositing coal particles on a transfer plate device to provide an uncompacted bed of coal, the transfer plate device having a translatable spatula, side walls and at least one movable end wall;

applying pressure to an upper surface of the uncompacted coal bed while degassing the coal bed to provide a dry, compacted coal bed having a bulk density ranging from about 960 to about 1200 kilograms per cubic meter, wherein degassing the coal bed is selected from the group consisting of applying a vacuum source to one or more probes inserted in the uncompated coal bed and venting air through one or more probes inserted into the uncompated coal bed;

translating the spatula containing compacted coal into the coke oven;

removing the spatula from the coke oven while retaining the compacted coal in the coke oven; and conducting a coking process on the compacted coal in the coke oven.

18. The method of claim 17, wherein the degassing process is comprised of applying a vacuum to the coal bed.

19. The method of claim 18, wherein the vacuum applied to the coal bed is applied by a vacuum source that generates a vacuum ranging from about 185 to about 280 mm Hg.

20. The method of claim 17, wherein pressure is applied to the upper surface of the uncompacted coal bed using impact energy ranging from about two up to about 3.5 kilogram-force meter/kilogram of coal.

21. The method of claim 17, wherein the degassing process is comprised of applying a vacuum source to one or more probes inserted in the uncompacted coal bed.

22. The method of claim 17, wherein the degassing process comprises venting air through one or more probes inserted into the uncompacted coal bed.

23. The method of claim 17, wherein the coal particles are compacted to the bulk density ranging from about 960 to about 1200 kilograms per cubic meter from an initial bulk density ranging from about 640 to about 800 kilograms per cubic meter in less than about three minutes.

24. The method of claim 17, the step of applying pressure to the upper surface of the uncompacted coal bed comprises impacting the uncompacted coal bed with from one to about five impacts applied to a pressure plate in contact with the upper surface of the uncompacted coal bed.

* * * * *